US010123946B2

(12) United States Patent
Tesini et al.

(10) Patent No.: US 10,123,946 B2
(45) Date of Patent: Nov. 13, 2018

(54) TEAT FOR FEEDING BOTTLE

(75) Inventors: David A. Tesini, Hopkinton, MA (US); Joshua P. Wiesman, Boston, MA (US)

(73) Assignee: Momma Goose, Inc., Wayland, MA (US)

( * ) Notice: Subject to any disclaimer, the term of this patent is extended or adjusted under 35 U.S.C. 154(b) by 197 days.

(21) Appl. No.: 14/009,748

(22) PCT Filed: Apr. 2, 2012

(86) PCT No.: PCT/US2012/031787
§ 371 (c)(1),
(2), (4) Date: Jan. 23, 2015

(87) PCT Pub. No.: WO2012/138592
PCT Pub. Date: Oct. 11, 2012

(65) Prior Publication Data

US 2015/0202122 A1 Jul. 23, 2015

Related U.S. Application Data

(60) Provisional application No. 61/472,834, filed on Apr. 7, 2011.

(51) Int. Cl.
*A61J 11/02* (2006.01)
*A61J 11/04* (2006.01)
*A61J 11/00* (2006.01)

(52) U.S. Cl.
CPC ..... *A61J 11/02* (2013.01); *A61J 11/005* (2013.01); *A61J 11/006* (2013.01); *A61J 11/0065* (2013.01); *A61J 11/04* (2013.01)

(58) Field of Classification Search
CPC ..... A61J 11/002; A61J 11/0065; A61J 11/02
(Continued)

(56) References Cited

U.S. PATENT DOCUMENTS 1,510,571 A * 10/1924 Ware ..... A61J 11/02 215/11.5
3,113,569 A * 12/1963 Barr ..... A61J 11/0065 215/11.1

(Continued)

FOREIGN PATENT DOCUMENTS

WO 2012/138592 10/2012

OTHER PUBLICATIONS

International Search Report for related PCT App. No. PCT/US12/31787 dated Jun. 22, 2012.

*Primary Examiner* — Sue A Weaver
(74) *Attorney, Agent, or Firm* — Fish & Richardson P.C.

(57) ABSTRACT

A feeding teat (40) constructed and arranged to be used on a bottle (52) that holds and dispenses a liquid to be fed to an infant or child. The teat (40) has a nipple portion (70) with an orifice (71) at a terminal end, and defines an interior profile shaped by intersecting reverse curves (75, 76) that generally decrease the interior diameter of the nipple portion (70) toward the orifice (71), so as to channel fluid flow into the orifice (112). There is a flange portion (66) constructed and arranged to be releasably coupled to the bottle (52) such that the liquid can flow from the bottle (52) into the teat (40), and a convexly shaped intermediate portion (80) integrally connecting the nipple portion (70) to the flange portion (66). A pressure relief valve (60) built into the teat (40) is constructed and arranged to admit air into the interior of at least one of the teat (40) and the bottle (52).

28 Claims, 8 Drawing Sheets

(58) Field of Classification Search
USPC ..... 215/11.4, 11.5
See application file for complete search history.

(56) References Cited

U.S. PATENT DOCUMENTS

| | | | | |
|---|---|---|---|---|
| 5,784,999 | A * | 7/1998 | Larson | A01K 9/005 119/71 |
| 5,797,505 | A | 8/1998 | Kaura | |
| 5,881,893 | A | 3/1999 | Manganiello | |
| 6,758,364 | B1 | 7/2004 | Rohrig | |
| 6,883,672 | B2 * | 4/2005 | Dunn | A61J 9/00 215/11.1 |
| 2003/0089676 | A1 | 5/2003 | Uehara et al. | |
| 2004/0220618 | A1 * | 11/2004 | Rohrig | A61J 11/0035 606/234 |
| 2005/0252875 | A1 * | 11/2005 | Sheu | A61J 11/02 215/11.5 |
| 2008/0128379 | A1 | 6/2008 | Hen | |
| 2008/0210655 | A1 | 9/2008 | Rees et al. | |
| 2009/0039046 | A1 | 2/2009 | Marr et al. | |
| 2009/0200257 | A1 * | 8/2009 | McKendry | A61J 9/04 215/11.5 |
| 2009/0314736 | A1 | 12/2009 | Rigert et al. | |
| 2012/0012550 | A1 * | 1/2012 | Boonprasop | A61J 11/02 215/11.4 |
| 2012/0267334 | A1 * | 10/2012 | Yamashita | A61J 11/02 215/11.5 |
| 2013/0056435 | A1 * | 3/2013 | Itzek | A61J 11/02 215/11.5 |

* cited by examiner

SECTION L-L

DETAIL N

SECTION B-B

TEAT FOR FEEDING BOTTLE

BACKGROUND

Feeding teats are placed on bottles that are used to feed infants and children. Turbulence in flow of liquid proximate the teat outlet (which is in the nipple of the teat) can cause the introduction of air bubbles which are then swallowed by the infant. Additionally, the amount of work (suction) required to draw the liquid from the teat can cause the infant to take in additional air by breaking the latch (seal between lips and outside of the teat). Regardless, air intake causes discomfort, and can be a source of "colic." Also, in typical teats the contents of the liquid (minerals/vitamins and sometimes solids in solution or in a thin slurry) can settle or be pushed away from the liquid in the solution depending on the pattern of flow.

When infants suck on typical teats they must learn to pause periodically to let air into the bottle so as to equalize the pressure in the bottle. This can cause frustration. Some teat designs include valves that are meant to channel air from outside (atmosphere) into the bottle during suck (negative pressure). This air may be kept away from the feeding zone and prevent a vacuum from forming in the bottle. The valves integrated into the teat add to the complexity and expense of the teat. Also, these valves may not be sufficiently functional.

SUMMARY

The teat disclosed herein may accomplish one or more of the following goals. It can reduce turbulent delivery of milk, formula or other feeding liquids to improve consistency. It can reduce turbulence so as to reduce cavitation, or the incorporation of air-bubbles that cause colic. It includes an anatomical nipple design that better simulates mother and way baby feeds from mother. It reduces the amount of work (suction) required by the infant to draw the fluid from the teat.

The vent(s) in the teat keep air away from the nipple and keep fluid moving smoothly. In one embodiment the venting valve(s) are located in the region of the teat where it is coupled to the bottle. These valves can be formed in part by the teat and in part by the regions of the bottle that are contacted by these parts of the teat. In another embodiment the valve is molded directly into the teat and extends into its interior.

The teat has a nipple that directs the liquid in a more laminar flow through and out of the teat, to reduce turbulence and areas of fluid stall in the liquid and thus inhibit air bubble integration and further inhibit the contents of the liquid from settling or being pushed away from the liquid. The system for relieving pressure in a feeding bottle with a teat may comprise one or more pressure relief valves incorporated at one or more locations of the teat. The valves may be accomplished between the inside surface of the bottle and the teat via an extension of the teat with its distal end resting against the inside surface of bottle. The teat can include multiple valves, e.g., two or three valves spaced about 180 or 120 degrees apart around the periphery of the teat, respectively. The valves may be in the base of the teat that is fitted onto the bottle. The teat may define an open undercut that leaves an area between the bottle and the teat open to the atmosphere, such that as the pressure inside the bottle drops, atmospheric pressure pushes the extension away from the bottle to allow air to flow into the bottle.

This disclosure features a feeding teat constructed and arranged to be used on a bottle that holds and dispenses a liquid to be fed to an infant or child. The teat has a nipple portion having an orifice at a terminal end, and defining an interior profile shaped by intersecting reverse curves that generally decrease the interior diameter of the nipple portion toward the orifice, so as to channel fluid flow into the orifice, a flange portion constructed and arranged to be releasably coupled to the bottle such that the liquid can flow from the bottle into the teat, a convexly shaped intermediate portion integrally connecting the nipple portion to the flange portion, and a pressure relief valve constructed and arranged to admit air into the interior of at least one of the teat and the bottle.

A first of the intersecting reverse curves can be concave relative to the interior of the teat, and a second reverse curve can be convex relative to the interior of the teat. The first curve may be farther from the orifice than the second curve. The interior profile of the nipple portion may further define a third curve that intersects the second curve, is concave relative to the interior of the teat and is closer to the orifice than the second curve. The third curve may transition into the orifice: this transition may or may not be direct, as there may be a fourth reverse curve that is directly adjacent to the orifice.

The wall thickness of the teat may generally increase along the lengths of the first and second curves. The wall thickness may also decrease in a nipple portion proximal region where the nipple portion transitions into the intermediate portion. The proximal region may define an interior profile that is convexly curved. The intermediate portion of the teat may define an interior profile that is concavely curved. The intermediate portion interior profile may be concavely curved along substantially all of its length.

The pressure relief valve may include generally parallel walls that project inwardly from the intermediate portion. The teat may be generally concentric about a centerline that lies along the orifice, and the pressure relief valve walls may be generally parallel to the centerline. The pressure relief valve walls may be spaced from each other and may be connected together at the lower ends by a transverse wall. The transverse wall may be slit. The slit may be made by a blade. The pressure relief valve may comprise two essentially parallel walls directed inwardly from the exterior wall of the teat. The valve walls may each be separated from the exterior wall of the teat by at least transverse walls that help to mechanically isolate the valve walls from the body of the teat. The transverse walls may be generally elliptical or circular. The valve walls may be connected at their distal ends by a short connecting wall that is slightly thinner than the valve walls. The connecting wall may define a generally arc-shaped (e.g., semi-circular) edge.

The pressure relief valve may at least in part be located in the flange portion. The pressure relief valve may comprise a skirt projecting downwardly and outwardly from the inner part of the flange and constructed and arranged to rest against the sidewall of the bottle, and a channel in the underside of the flange that communicates with a volume between the skirt and the sidewall of the bottle.

The teat may further include at least three spaced ribs on the inside surface of the teat. The ribs may comprise a first section in the intermediate portion of the teat and a second section in the nipple portion of the teat. The first section of the ribs may be generally radial and relatively wide, and the second section may be narrower and angled at from about 45 degrees to about 75 degrees relative to the teat centerline.

Also featured herein is a feeding teat constructed and arranged to be used on a bottle that holds and dispenses a liquid to be fed to an infant or child, the teat comprising a nipple portion having an orifice at a terminal end, and defining an interior profile shaped by at least three intersecting reverse curves, wherein a first intersecting reverse curve is concave relative to the interior of the teat, a second reverse curve is convex relative to the interior of the teat, and a third reverse curve intersects the second curve and is concave relative to the interior of the teat, wherein the first curve is farther from the orifice than the second curve, and the third curve is closer to the orifice than the second curve and transitions into the orifice. The curves generally decrease the interior diameter of the nipple portion toward the orifice, so as to channel fluid flow into the orifice. The wall thickness of the teat generally increases along the lengths of the first and second curves, and decreases in a nipple portion proximal region where the nipple portion transitions into the intermediate portion, wherein the proximal region defines an interior profile that is convexly curved. The teat also comprises a flange portion constructed and arranged to be releasably coupled to the bottle such that the liquid can flow from the bottle into the teat, and a convexly shaped intermediate portion integrally connecting the nipple portion to the flange portion. The intermediate portion defines an interior profile that is concavely curved along substantially all of its length, and a pressure relief valve constructed and arranged to admit air into the interior of the teat, wherein the pressure relief valve includes generally parallel walls that project inwardly from the intermediate portion, wherein the teat is generally concentric about a centerline that lies along the orifice and the pressure relief valve walls are generally parallel to the centerline, are spaced from each other and are connected together at the lower ends by a transverse wall with an opening through it, to allow the passage of air.

Further featured herein is a feeding teat constructed and arranged to be used on a bottle that holds and dispenses a liquid to be fed to an infant or child, the teat comprising a nipple portion having an orifice at a terminal end, and defining an interior profile shaped by at least three intersecting reverse curves, wherein a first intersecting reverse curve is concave relative to the interior of the teat, a second reverse curve is convex relative to the interior of the teat, and a third reverse curve intersects the second curve and is concave relative to the interior of the teat, wherein the first curve is farther from the orifice than the second curve, and the third curve is closer to the orifice than the second curve and transitions into the orifice. The curves generally decrease the interior diameter of the nipple portion toward the orifice, so as to channel fluid flow into the orifice. The wall thickness of the teat generally increases along the lengths of the first and second curves, and decreases in a nipple portion proximal region where the nipple portion transitions into the intermediate portion, wherein the proximal region defines an interior profile that is convexly curved. There is a flange portion constructed and arranged to be releasably coupled to the bottle such that the liquid can flow from the bottle into the teat, and a convexly shaped intermediate portion integrally connecting the nipple portion to the flange portion. The intermediate portion defines an interior profile that is concavely curved along substantially all of its length. There is a pressure relief valve constructed and arranged to admit air into the interior of the teat, wherein the pressure relief valve comprises a skirt projecting downwardly and outwardly from the inner part of the flange and constructed and arranged to rest against the sidewall of the bottle, and a channel in the underside of the flange that communicates with a volume between the skirt and the sidewall of the bottle.

DESCRIPTION OF EMBODIMENTS

Figure 1:
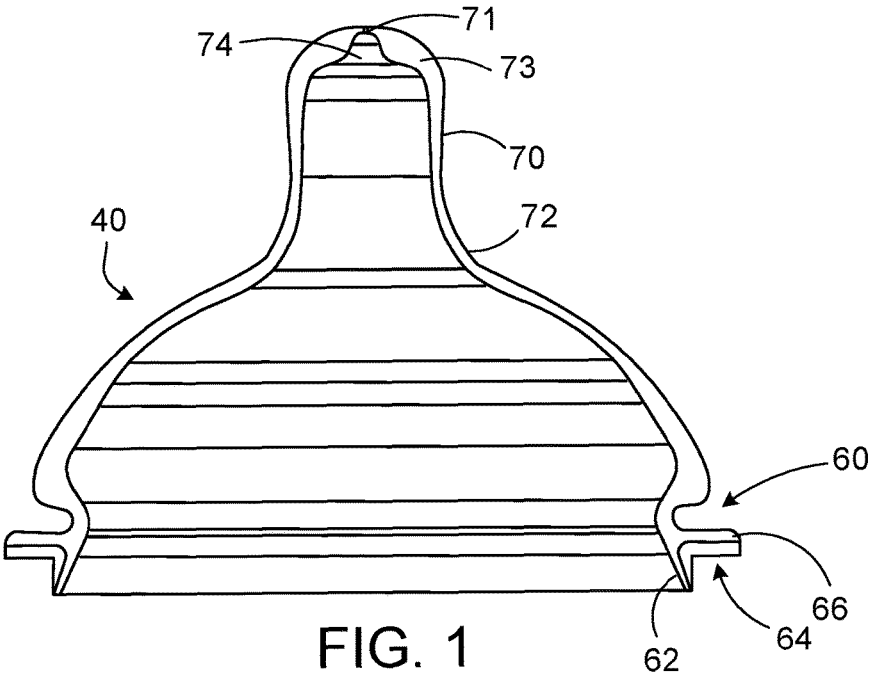
FIG. 1 is a cross-sectional view of one embodiment of a feeding teat.
Figure 2:
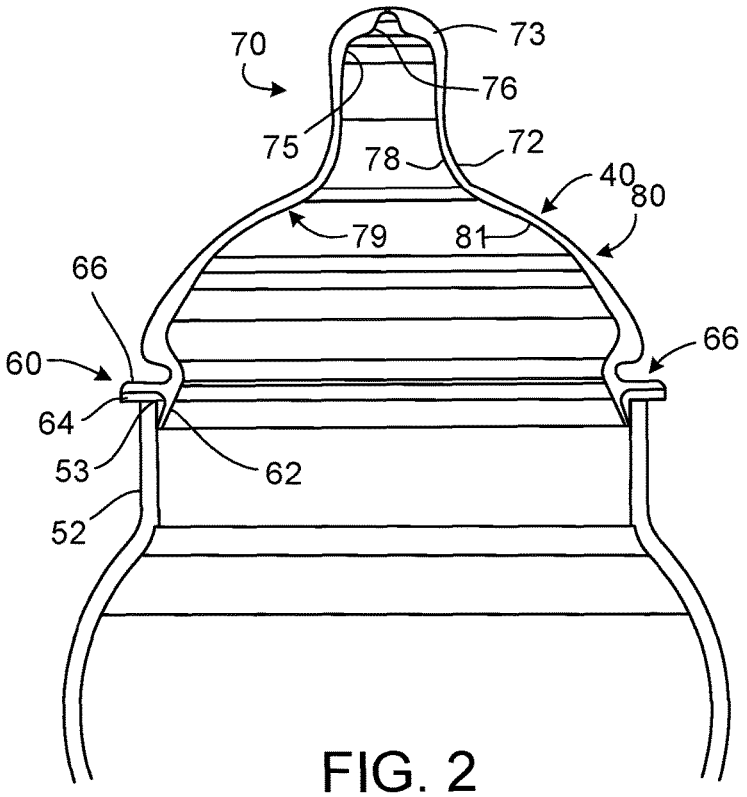
FIG. 2 shows the teat of FIG. 1 on a bottle.
Figure 3:
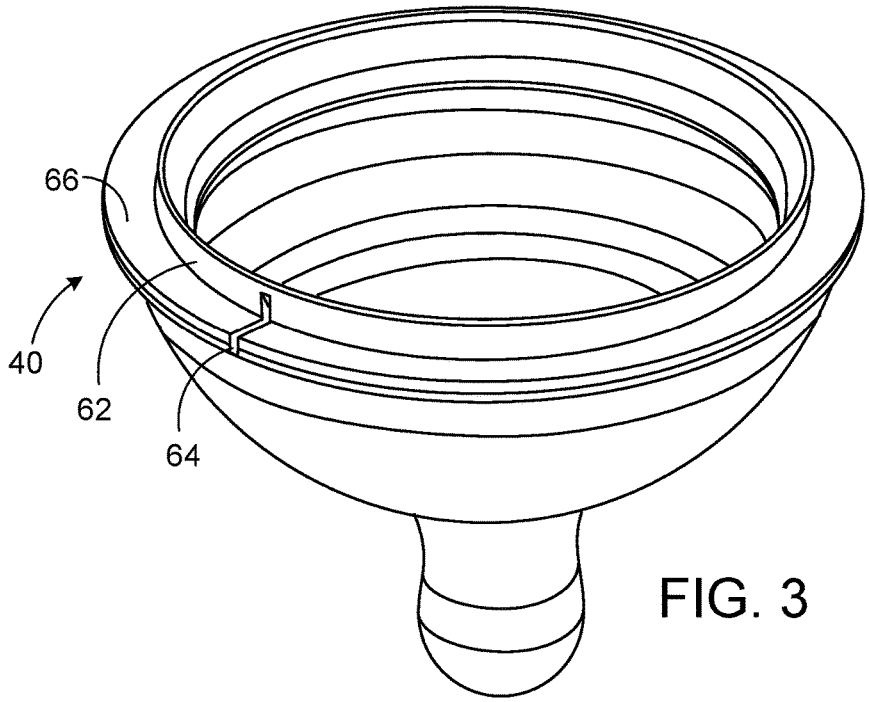
FIG. 3 is a bottom perspective view of the teat of FIG. 1 showing the construction that accomplishes a pressure relief valve.

Teat 40 with nipple 70, FIGS. 1-3, directs the milk/liquid in a relatively laminar flow through and out of the nipple through outlet 71. Teat 40 can be an integral molded item that is typically made from medical grade silicone of 30-40 durometer. The laminar flow into the outlet is in part accomplished by the interior profile of wall 73 that smoothly steps the diameter down to terminal portion 74 and through opening 71. The interior shape 79 of teat 40 as a whole includes concave interior surface 81 of intermediate teat portion 80 that has a convex exterior shape. Nipple proximal region 72 has a convex interior shape 78. First interior nipple portion wall curve 75 is concave, second interior wall curve 76 is convex and third interior wall curve 77 is concave. The series of two or more reverse curves accomplishes a gradual narrowing of the interior diameter, which accomplishes a more laminar flow than a typical nipple with a single concave wall that leads to the orifice/outlet. This reduces turbulence in the liquid and thus inhibits air bubble integration. This will also inhibit the contents of the liquid (e.g., foodstuffs, minerals/vitamins) from settling or being pushed away from the liquid in the solution. Also, the wall 73 proximate orifice or opening 71 that generally increases in thickness from the proximal region toward the outlet provides more stiffness proximate opening (valve) 71, thus the valve functions more effectively to inhibit leakage. Also, because neck or nipple proximal region 72 is thinner, when an infant sucks on nipple 70, region 72 can flex, which allows the stiffer nipple to be drawn into the mouth more naturally, to mimic actions that take place when an infant feeds from its mother.

FIGS. 1-3 also illustrate an embodiment of a pressure relief valve 60 incorporated into teat 40. One or more such valves can be incorporated. In this embodiment the valves are accomplished between the upper wall 52 of the bottle to which the teat is attached (which can be any standard bottle and so is not fully shown in the drawings) and the teat 40, via integral annular teat extension or skirt 62 with its distal end resting against the inside surface of wall 52. Integral annular teat flange 66 defines open undercut 64 that leaves volume 53 between the bottle and the teat open to the atmosphere. As the pressure inside the bottle drops, atmospheric pressure pushes skirt 62 at the location of open volume 53 away from the bottle to allow air to flow into the bottle. Skirt 62 is deformable (e.g., by being made from an elastomer such as silicone, and due to its mechanical design, its flexibility, and the manner in which it contacts the bottle). Air is thus channeled from outside (atmosphere) into the bottle during suck (negative pressure). This air is kept away from the feeding zone (the valves are at the end of the teat farthest from the outlet opening in the nipple), and allows the prevention of a vacuum in the bottle. This also allows for one shot molding of the teat and does not rely on post-processing (e.g., a knife slit) of the material to create the valve.

Figure 4:
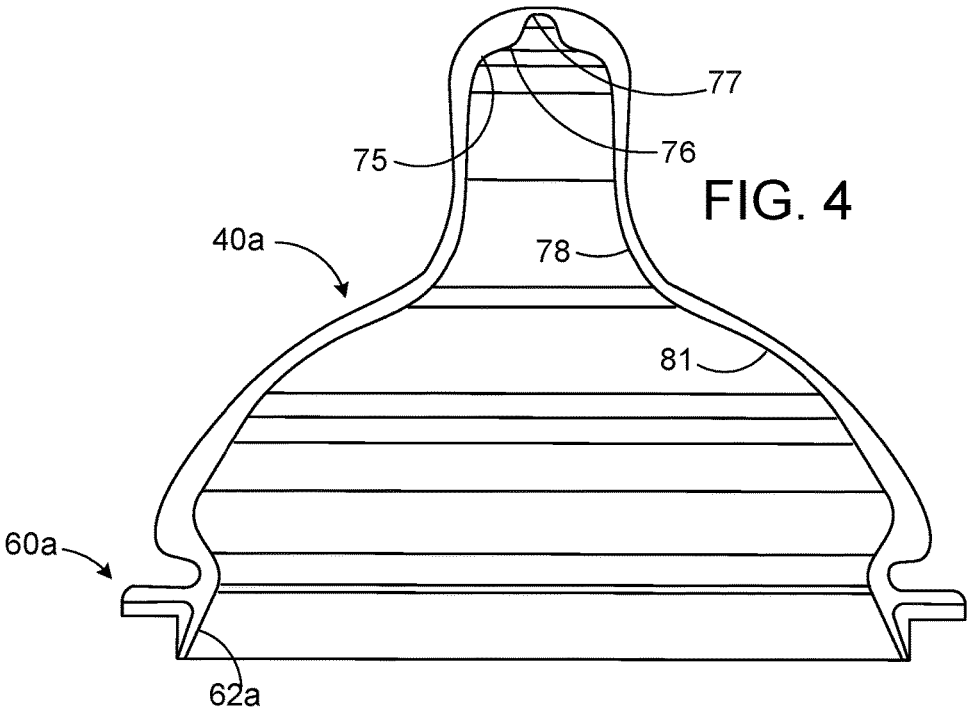
FIG. 4 is a greatly enlarged view of the teat of FIG. 1, but with a slightly different pressure relief valve construction.
Figure 5A:
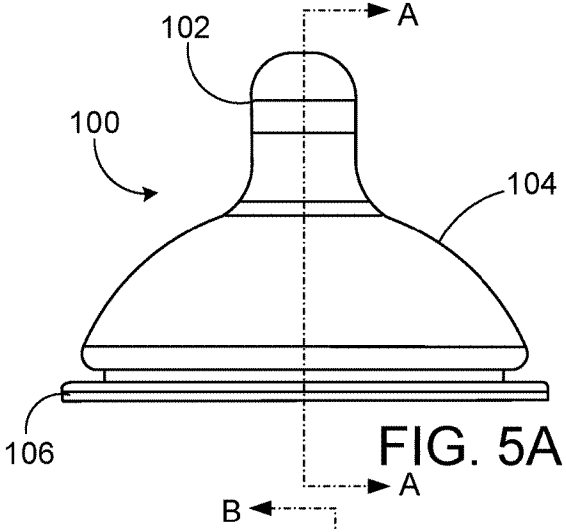
FIGS. 5A and 5B are side and cross-sectional views of a second embodiment of a feeding teat.
Figure 5B:
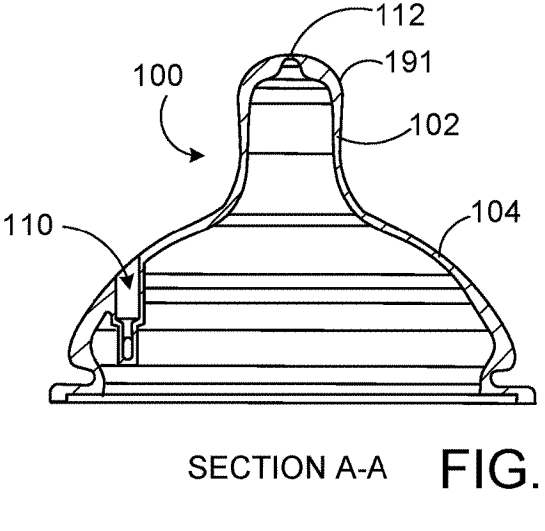
Figure 6A:
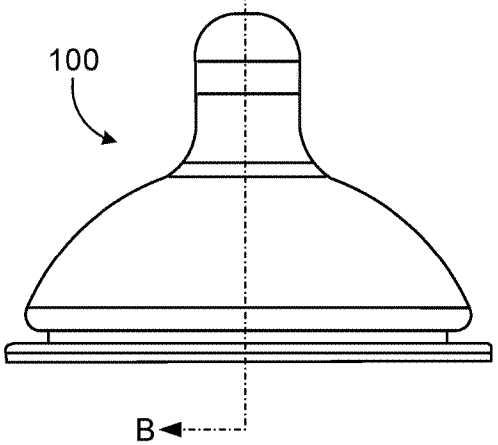
FIGS. 6A and 6B are different side and cross-sectional views of the second embodiment of a feeding teat.
Figure 6B:
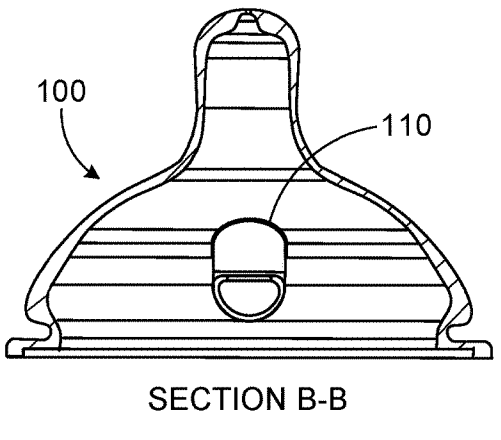
Figure 7A:
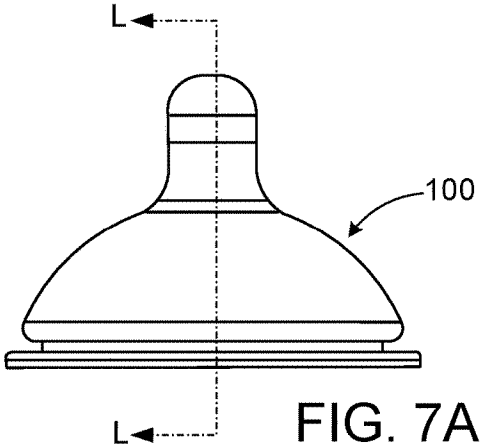
FIGS. 7A-7D are side, cross-sectional and two partial close-up views of the second embodiment of a feeding teat.
Figure 7B:
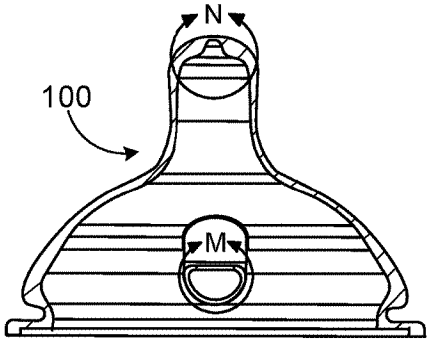
Figure 7C:
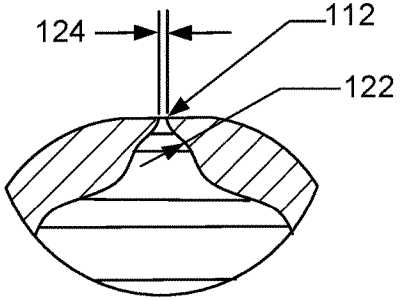
Figure 7D:
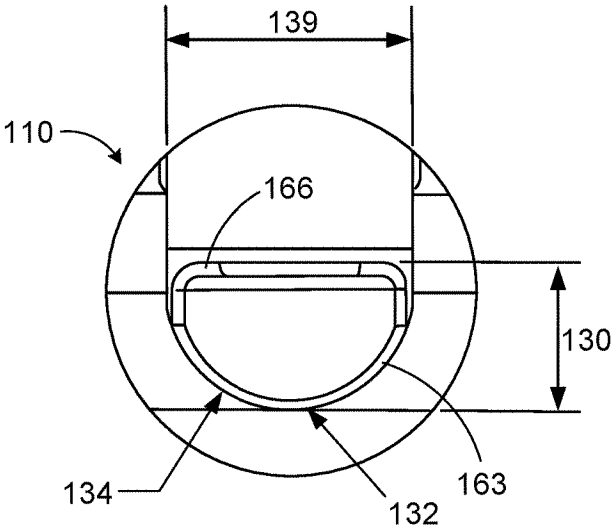
Figure 8B:
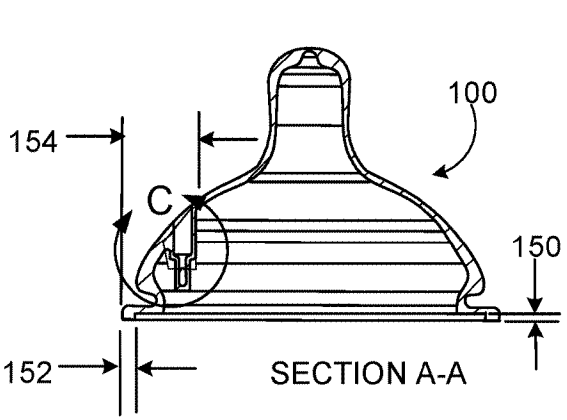
FIGS. 8A-8C are side, cross-sectional and a partial close-up views of the second embodiment of a feeding teat.
Figure 8A:
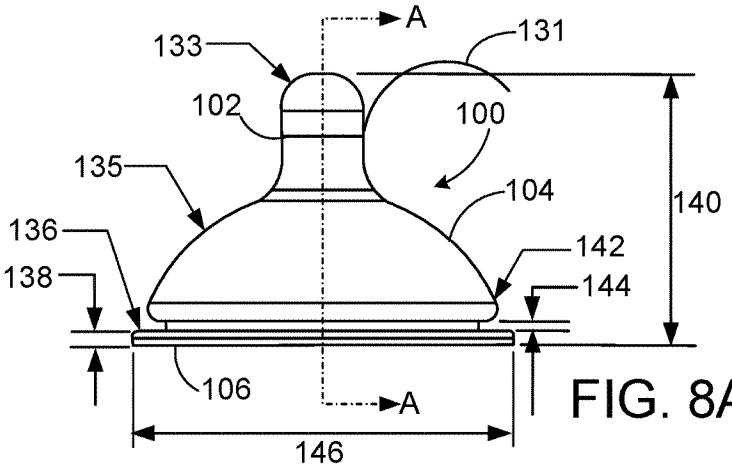
Figure 8C:
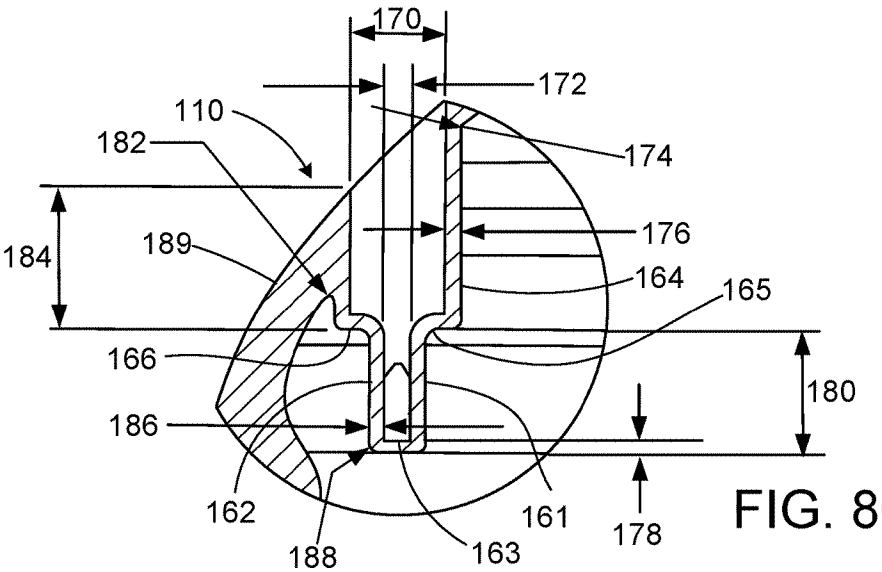
Figure 9A:
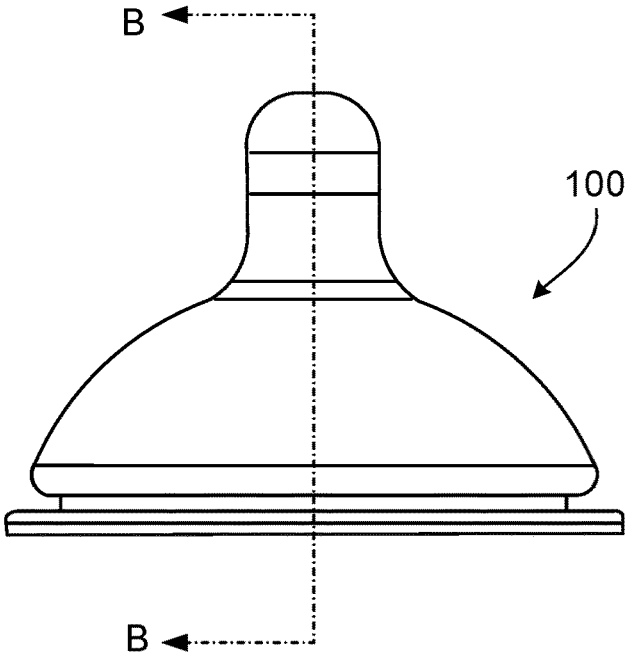
FIGS. 9A-9C are side, cross-sectional and a partial close-up views of the second embodiment of a feeding teat.
Figure 9B:
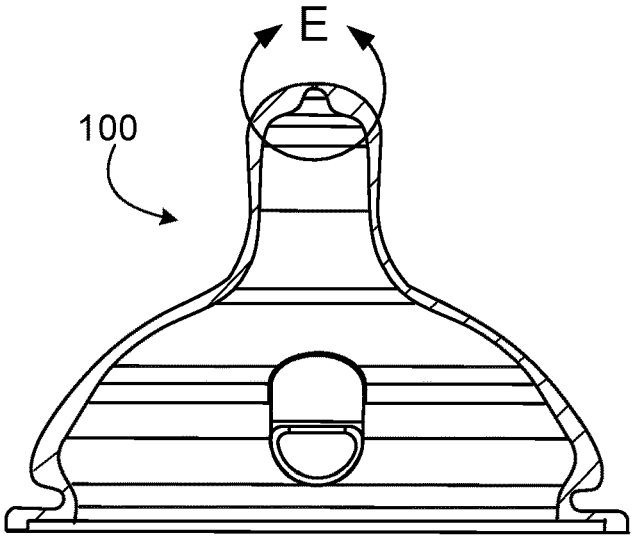
Figure 9C:
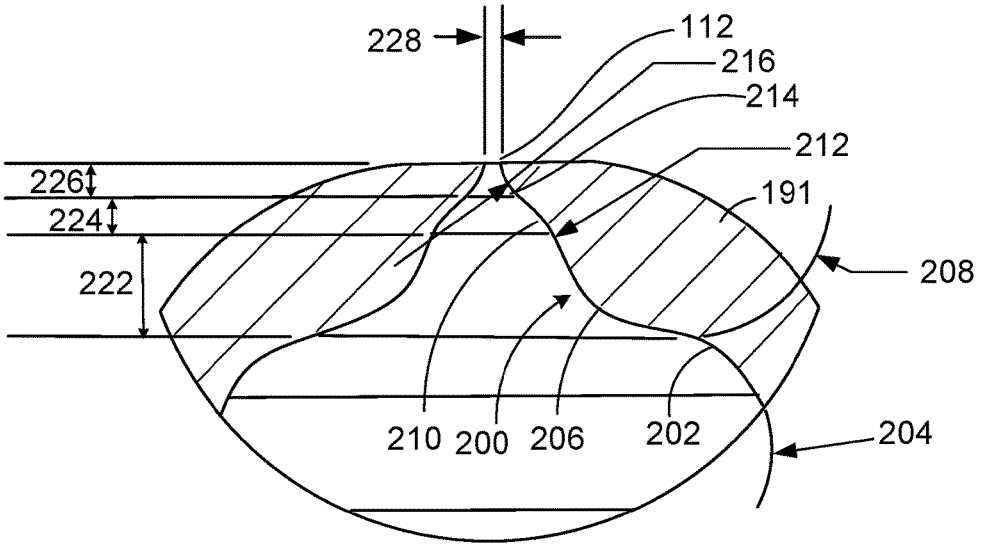

FIG. 4 depicts an alternative embodiment of the valve 60*a* in teat 40*a*, wherein extension or skirt 62*a* has a more parabolic shape as opposed to the straight extension 62 shown in FIGS. 1-3. This shape may create a better seal against bottle neck 52. The skirt can take other shapes and be constructed differently so as to accomplish a good liquid tight seal that will deflect slightly so as to allow air into the bottle when a sufficient negative pressure is reached inside the bottle.

In teat 40, air flows in from outside of the bottle to neutralize pressure. The bottle neck insert on the teat acts as valve. Multiple valves can be spaced around the periphery of the base or flange of the teat, typically but not necessarily evenly spaced around the periphery. For example, two valves located 180 degrees from each other or three valves located 120 degrees from one another. The one piece molded teat has a valve mechanism that is not very compression sensitive so can be coupled to the bottle like a normal teat without a valve in its flange.

FIGS. 5-9 illustrate a second embodiment. Teat 100 includes nipple portion 102 with outlet orifice 112, intermediate portion 104, flange portion 106 that is adapted to be coupled to a bottle, and pressure relief valve 110. As with the first embodiment, teat 100 is integrally molded from silicone. Feed hole 112 can be created in the molding process or can be created post-molding with a mechanical punch or a laser. For slow feed rates of 6-12 ml/minute hole 112 is typically from about 0.25 to about 0.53 mm in diameter 124. For intermediate feed rates of 9-19 ml/minute hole 112 is typically from about 0.46 to about 0.65 mm in diameter. For fast feed rates of 17-25 ml/minute hole 112 is typically from about 0.58 to about 0.77 mm in diameter. Feed rates were determined with water.

Valve 100 comprises flexible parallel walls 161 and 162 connected at their lower ends by transverse wall 163, which is slit so as to provide a path for air to enter the inside of the teat. The slit 132 in lower valve wall 163 is created by a blade and rigging fixture. The slit is nominally set to a width of 5 mm±0.5 mm. The curved lower wall 163 of the valve increases its stiffness and thus decreases the chances of fluid leakage, as compared to a linear wall. Vertical wall 164 locates wall 165 sufficiently offset from teat wall 189 such that walls 165 and 166 are at the same depth. Curved (typically circular or elliptical) transverse walls 165 and 166 serve to separate the pressure-sensitive walls 161 and 162 that are part of the valve from the main body of the teat. This means that the thin, sensitive walls 161 and 162 are not affected or at least less affected by stretching or twisting of the teat in use than would be the case if walls 161 and 162 were directly connected to main wall 189 of the teat. This makes the valve function better under typical usage scenarios where the teat is stretched and twisted in use. It may be possible to change the sensitivity of the valve even more by making a valve with a different durometer, or out of a different material than the rest of the teat, in a two-shot molding process. Silicone and many other thermoplastic elastomers will stick together over time after they have been slit. This may require the user to pinch the valve before use to assure that it is "open" and functional. Using a different material that does not stick to this extent over time could resolve this potential issue.

As in the first embodiment, the nipple portion is designed to accomplish a relatively laminar flow into the orifice. The terminal part of the nipple portion defines interior wall 200. First curve 202 is concave. Second curve 206 is convex. Third curve 210 is concave. Fourth curve 214 (which leads directly into orifice 112) is convex. This series of four reverse curves accomplishes a smoothly-decreasing interior diameter that supports laminar flow into orifice 112. Teat wall 191 generally increases in thickness from portion 72 and along at least part of wall 206, up to where walls 210 and 214 are located. This helps to maintain the stiffness of the nipple in the portion that delivers the fluid.

In one non-limiting embodiment that illustrates the disclosure, the radii of curvature and dimensions of a teat of the type shown in FIGS. 5-9 are as follows. Note that the radii and dimensions are adjustable, subject to finite element analysis to determine that the flow is relatively laminar. On average, the radii can be defined as about ±0.5 mm for smaller radii to as much as about ±1 mm for larger radii. Distance variation can be more liberal, likely as much as plus 3 mm more.

Radius 122: 0.750 mm
Radius 131: 13.53 mm
Radius 133: 5.52 mm
Radius 134: 4.5 mm
Radius 135: 30 mm
Radius 136: 1 mm
Radius 142: 2 mm
Radius 174: 0.25 mm
Radius 182: 0.25 mm
Radius 188 (4 places): 0.500±0.025 mm
Radius 204: 2 mm
Radius 208: 2.471 mm
Radius 212: 1.042 mm
Radius 216: 0.750 mm
Dimension 130: 5.500 mm
Dimension 132 (the width of the slit 132 in curved lower wall 163 of valve 110): 5 mm
Dimension 138: 2.134 mm
Dimension 139: 9±0.025 mm
Dimension 140: 44±0.127 mm
Dimension 144: 1.87 mm
Dimension 146: 60.50 mm
Dimension 150: 1 mm
Dimension 152: 2 mm
Dimension 154: 12.25 mm
Dimension 170: 3.800±0.127 mm
Dimension 172: 1±0.025 mm
Dimension 176: 0.600±0.025 mm
Dimension 178: 0.500±0.025 mm
Dimension 180: 5±0.025 mm
Dimension 184: 5.72 mm
Dimension 186 (2 places): 0.600±0.025 mm
Dimension 222: 1.757 mm
Dimension 224: 0.617 mm
Dimension 226: 0.633 mm
Dimension 228: 0.250 mm Quantitative tests were run on teat 100 as compared to two standard teats with a single concave internal nipple wall leading to the orifice. For a given mass flow rate out of the teat, the required pressure vacuum to be created by the infant was at least 26% less than the other two designs, meaning that the child needs to expend less energy to obtain the same amount of milk/liquid. Also the child will experience less frustration during feeding, as flow comes easier. The two standard designs required 36% and 78% greater pressure drop to maintain the same flow rate of 2e-4 kg/sec. as compared to teat 100. Standard data establish that the peak negative vacuum that can be developed in an infant's mouth is about 145±58 mm Hg. At 145 mm Hg the subject teat delivered 16.6 cc/min as compared to 12.5 and 14.2 cc/min for the two standard designs.

Figure 10A:
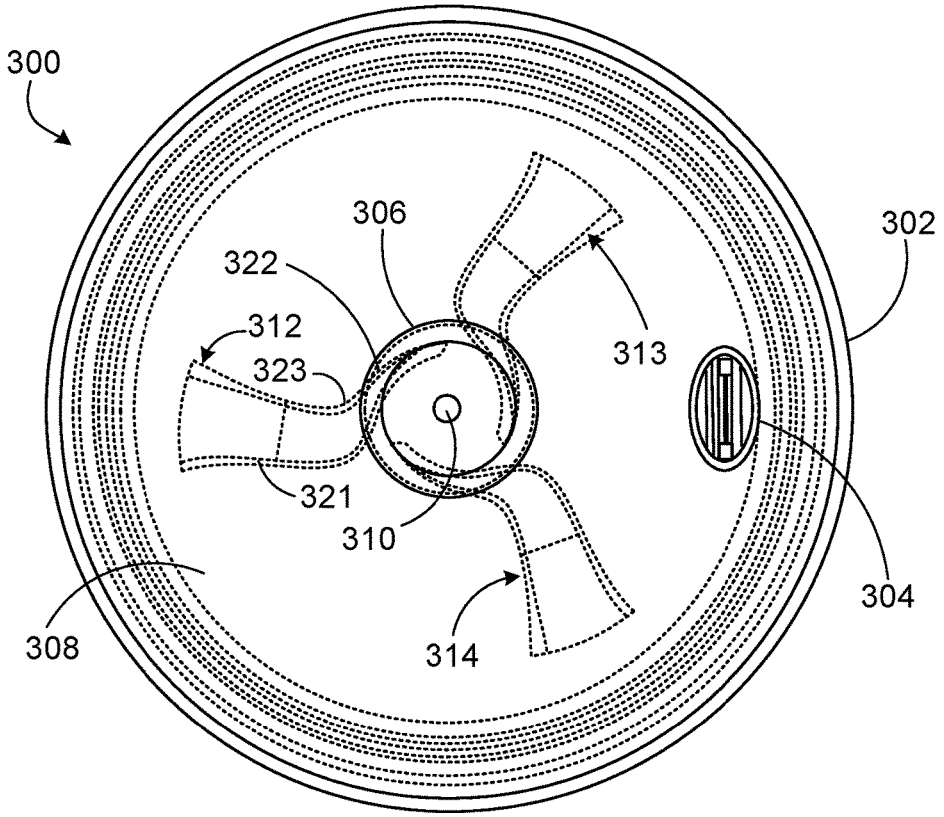
FIGS. 10A-10C are top, side and perspective views of another embodiment of a feeding teat.
Figure 10B:
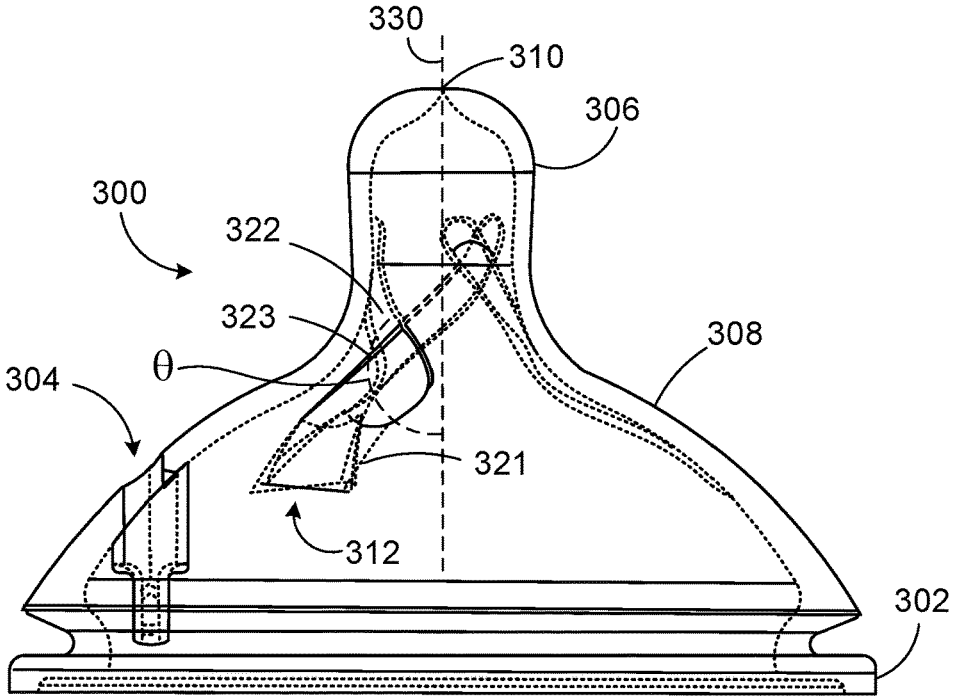
Figure 10C:
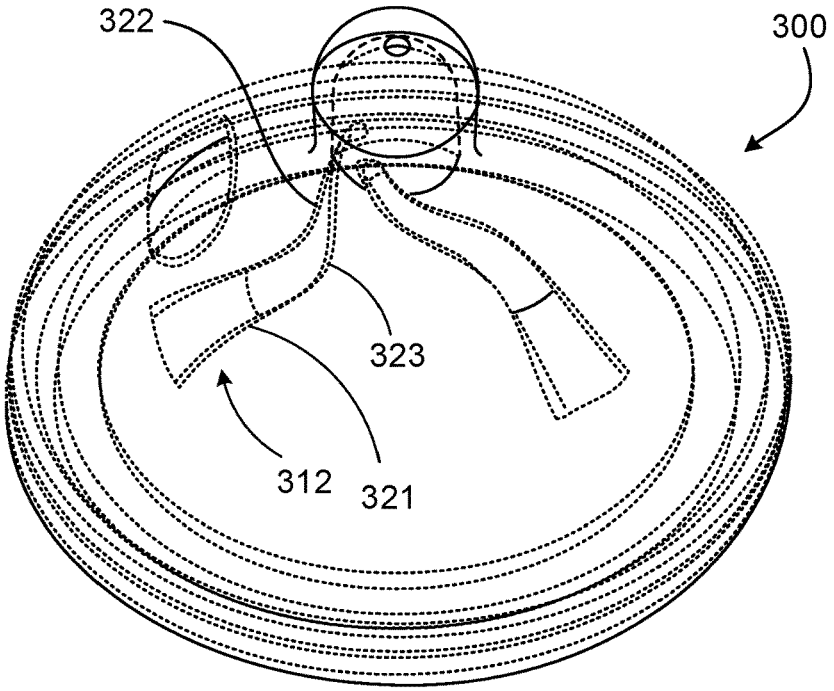

FIG. 10A-10C show the optional addition of three (or more—potentially four or five) internal ribs 312-314 that run from the intermediate portion 308 of teat 300 into the nipple portion 306. Valve 304 is shown. The ribs help to maintain an open flow path even if the infant bites down on the teat. Rib portion 321 that lies along the inside wall of intermediate portion 308 is generally radial with respect to the teat centerline 330 (a vertical line running through orifice 310, coming directly out of the page in FIG. 10A, and illustrated in FIG. 10B), while inflection location 323 alters the direction of portion 322 to one that is angled along the inside of the nipple proximal portion; this configuration prevents the nipple from fully collapsing if it is bitten down on by the infant. The angle θ of upper portion 322 relative to the teat centerline 330 is typically between about 45 degrees and about 75 degrees; an angle of about 65 degrees is illustrated. The ribs are typically about 5 mm wide at their widest (closest to flange 302) and taper to about 2 mm 4 mm at the top. The height or protrusion of the ribs from the interior wall is typically 2 mm±1 mm; at their widest point they gradually decrease in height so as to end flush with the interior wall. The ribs allow for the teat to stretch into the child's mouth during a suck, while preventing the base of the teat from collapsing or kinking inward under a stretch force as the child sucks on the nipple. This inward stretch is similar to the action of the nipple of a breast during breastfeeding.

Other embodiments will occur to those skilled in the field and are within the scope of the claims.

What is claimed is:

1. A feeding teat constructed and arranged to be used on a bottle that holds and dispenses a liquid to be fed to an infant or child, the feeding teat comprising:

a nipple portion having an orifice at a terminal end and defining an interior profile shaped by a plurality of intersecting reverse curves that generally decreases an interior diameter of the nipple portion toward the orifice, so as to channel fluid flow into the orifice, the plurality of intersecting reverse curves comprising:

a concave curve adjacent the orifice, and a convex curve adjacent the concave curve and at which the nipple portion has a maximum wall thickness to stiffen the terminal end at which the orifice is located;

a flange portion constructed and arranged to be releasably coupled to the bottle such that the liquid can flow from the bottle into the feeding teat;

an intermediate portion convexly shaped and integrally connecting the nipple portion to the flange portion; and a pressure relief valve constructed and arranged to admit air into an interior region of at least one of the feeding teat and the bottle.

2. The feeding teat of claim 1, wherein the concave curve is a first concave curve, and wherein the plurality of intersecting reverse curves further comprises a second concave curve adjacent the convex curve.

3. The feeding teat of claim 2, wherein the second concave curve is farther from the orifice than the convex curve.

4. The feeding teat of claim 3, wherein a wall thickness of the nipple portion generally increases in a direction from the second concave curve to the convex curve.

5. The feeding teat of claim 4, wherein the wall thickness of the nipple portion decreases in a direction from the second concave curve to a proximal region of the nipple portion where the nipple portion transitions into the intermediate portion.

6. The feeding teat of claim 5, wherein the interior profile of the nipple portion is convexly curved along the proximal region.

7. The feeding teat of claim 6, wherein the intermediate portion defines an interior profile that is concavely curved.

8. The feeding teat of claim 7, wherein the interior profile of the intermediate portion is concavely curved along substantially all of its length.

9. The feeding teat of claim 1, wherein the concave curve intersects the convex curve and is closer to the orifice than the convex curve.

10. The feeding teat of claim 1, wherein the concave curve transitions into the orifice.

11. The feeding teat of claim 10, wherein the concave curve transitions directly into the orifice.

12. The feeding teat of claim 1, wherein the pressure relief valve includes walls that are generally parallel and that project inwardly from the intermediate portion.

13. The feeding teat of claim 12, wherein the feeding teat is generally concentric about a centerline that lies along the orifice, and the walls of the pressure relief valve are generally parallel to the centerline.

14. The feeding teat of claim 13, wherein the walls of the pressure relief valve are spaced from each other and are connected together at lower ends by a transverse wall.

15. The feeding teat of claim 14, wherein the transverse wall has a slit.

16. The feeding teat of claim 15, wherein the slit is made by a blade.

17. The feeding teat of claim 1, wherein the pressure relief valve is at least in part located in the flange portion.

18. The feeding teat of claim 17, wherein the pressure relief valve comprises;

a skirt projecting downwardly and outwardly from an inner part of the flange portion and constructed and arranged to rest against a sidewall of the bottle, and a channel in an underside of the flange portion that communicates with a space between the skirt and the sidewall of the bottle.

19. The feeding teat of claim 1, wherein the pressure relief valve comprises two walls that are essentially parallel to each other and directed inwardly from a sidewall of the feeding teat.

20. The feeding teat of claim 19, wherein the two walls of the pressure relief valve are separated from the sidewall of the feeding teat by transverse walls that mechanically isolate the two walls from the sidewall of the feeding teat.

21. The feeding teat of claim 20, wherein the transverse walls have a generally elliptical or circular shape.

22. The feeding teat of claim 21, wherein the two walls of the pressure relief valve are connected at their distal ends by a short connecting wall that is slightly thinner than the two walls of the pressure relief valve.

23. The feeding teat of claim 22, wherein the short connecting wall defines a generally arc-shaped edge.

24. The feeding teat of claim 1, further comprising at least three ribs spaced apart from one another along an inside surface of the feeding teat.

25. The feeding teat of claim 24, wherein each of the three ribs comprises a first section in the intermediate portion of the feeding teat and a second section in the nipple portion of the feeding teat.

26. The feeding teat of claim 25, wherein the first section of the three ribs is generally radial and relatively wide, and the second section of the three ribs is relatively narrow and is angled at from about 45 degrees to about 75 degrees relative to a centerline of the feeding teat.

27. A feeding teat constructed and arranged to be used on a bottle that holds and dispenses a liquid to be fed to an infant or child, the feeding teat comprising:

a nipple portion having an orifice at a terminal end and defining an interior profile shaped by a plurality of intersecting reverse curves that generally decreases an interior diameter of the nipple portion toward the orifice, so as to channel fluid flow into the orifice, the plurality of intersecting reverse curves comprising:

a concave curve adjacent the orifice and transitioning directly into the orifice, and a convex curve adjacent the concave curve and at which the nipple portion achieves a maximum wall thickness to stiffen the terminal end at which the orifice is located;

a flange portion constructed and arranged to be releasably coupled to the bottle such that the liquid can flow from the bottle into the feeding teat;

an intermediate portion convexly shaped and integrally connecting the nipple portion to the flange portion; and a pressure relief valve constructed and arranged to admit air into an interior region of at least one of the feeding teat and the bottle, the pressure relief valve comprising two walls that are essentially parallel to each other and directed inwardly from a sidewall of the feeding teat, and the two walls of the pressure relief valve separated from the sidewall of the feeding teat by transverse walls that mechanically isolate the two walls from the sidewall of the feeding teat.

28. A feeding teat constructed and arranged to be used on a bottle that holds and dispenses a liquid to be fed to an infant or child, the feeding teat comprising:

a nipple portion having an orifice at a terminal end and defining an interior profile shaped by a plurality of intersecting reverse curves that generally decreases an interior diameter of the nipple portion toward the orifice, so as to channel fluid flow into the orifice, the plurality of intersecting reverse curves comprising:

a concave curve adjacent the orifice and transitioning directly into the orifice, and a convex curve adjacent the concave curve and at which the nipple portion achieves a maximum wall thickness to stiffen the terminal end at which the orifice is located;

a flange portion constructed and arranged to be releasably coupled to the bottle such that the liquid can flow from the bottle into the feeding teat;

an intermediate portion convexly shaped and integrally connecting the nipple portion to the flange portion; and a pressure relief valve constructed and arranged to admit air into an interior region of at least one of the feeding teat and the bottle, the pressure relief valve comprising:

a skirt projecting downwardly and outwardly from an inner part of the flange portion and constructed and arranged to rest against a sidewall of the bottle, and a channel in an underside of the flange portion that communicates with a space between the skirt and the sidewall of the bottle.

* * * * *